US010745859B2

(12) United States Patent
Ramaratnam et al.

(10) Patent No.: US 10,745,859 B2
(45) Date of Patent: Aug. 18, 2020

(54) CANNABIS FIBER, ABSORBENT CELLULOSIC STRUCTURES CONTAINING CANNABIS FIBER AND METHODS OF MAKING THE SAME

(71) Applicant: FIRST QUALITY TISSUE, LLC, Great Neck, NY (US)

(72) Inventors: Karthik Ramaratnam, Anderson, SC (US); James E. Sealey, II, Belton, SC (US); Byrd Tyler Miller, IV, Easley, SC (US); Taras Z. Andrukh, Greenville, SC (US)

(73) Assignee: First Quality Tissue, LLC, Great Neck, NY (US)

( * ) Notice: Subject to any disclaimer, the term of this patent is extended or adjusted under 35 U.S.C. 154(b) by 185 days.

(21) Appl. No.: 15/968,490

(22) Filed: May 1, 2018

(65) Prior Publication Data

US 2018/0245288 A1 Aug. 30, 2018

Related U.S. Application Data

(63) Continuation of application No. 14/939,675, filed on Nov. 12, 2015, now Pat. No. 9,988,763.
(Continued)

(51) Int. Cl.
*D21H 11/12* (2006.01)
*D21H 17/24* (2006.01)
(Continued)

(52) U.S. Cl.
CPC ..... *D21H 11/12* (2013.01); *D21C 5/00* (2013.01); *D21C 9/10* (2013.01); *D21F 11/14* (2013.01);
(Continued)

(58) Field of Classification Search
CPC ..... D21H 11/12; D21H 27/002; D21H 27/02; D21H 27/38; D21C 5/00; D21C 9/10; D21F 11/14; D21B 1/00; D21B 1/061
(Continued)

(56) References Cited

U.S. PATENT DOCUMENTS

2004/0154760 A1* 8/2004 Dean ..... D21C 7/00 162/18
2006/0162879 A1* 7/2006 Tinker ..... C08J 3/12 162/20
2012/0006501 A1* 1/2012 Golfman ..... D21H 11/12 162/181.1

FOREIGN PATENT DOCUMENTS

JP 2003-27389 * 1/2003

OTHER PUBLICATIONS

JP 2003-27389, English language machine translation [epo.org]. (Year: 2003).*

(Continued)

*Primary Examiner* — Eric Hug
(74) *Attorney, Agent, or Firm* — Amster, Rothstein & Ebenstein LLP

(57) ABSTRACT

A method to prepare, pulp, and bleach *cannabis* bast and hurd fibers to allow for the fiber to be incorporated into absorbent cellulosic structures on a wet-laid paper machine while keeping the pectin within the fibers. The wet laid paper machine can use the ATMOS, NTT, ETAD, TAD, or UCTAD method to produce the absorbent cellulosic structure. Absorbent cellulosic structures are produced with the *cannabis* bast and hurd fibers or with the bast fibers alone with the hurd fibers being combined with paper mill sludge or dust to form a fuel pellet.

4 Claims, 10 Drawing Sheets

Related U.S. Application Data

(60) Provisional application No. 62/078,737, filed on Nov. 12, 2014.

(51) Int. Cl.

| | |
|---|---|
| ***D21H 27/30*** | (2006.01) |
| ***D21H 27/00*** | (2006.01) |
| ***D21C 5/00*** | (2006.01) |
| ***D21C 9/10*** | (2006.01) |
| ***D21F 11/14*** | (2006.01) |

(52) U.S. Cl.
CPC ..... *D21H 17/24* (2013.01); *D21H 27/002* (2013.01); *D21H 27/30* (2013.01)

(58) Field of Classification Search
USPC ..... 162/98, 99, 148
See application file for complete search history.

(56) References Cited

OTHER PUBLICATIONS

Smook, Gary A., Handbook for Pulp & Paper Technologists, Second Edition, Chapter 13, pp. 194-208. (Year: 2001).*

* cited by examiner

| | Cannabis Bast Fiber | Typical Softwood | Cannabis Hurd Fiber | Typical Hardwood |
|---|---|---|---|---|
| Fiber length | 2-90 mm | 2-7 mm | 1-2 mm | 1-3 mm |
| Fiber diameter | 16-50 um | 30-40 um | 10-25 um | 15-30 um |
| % Cellulose | 70-80% | 40-44% | 33-49% | 40-44% |
| % Hemicellulose | 12-25% | 20-32% | 16-23% | 15-35% |
| % lignin | 2-10% | 25-35% | 16-28% | 18-25% |

Figure 8

| Overview | Instructions & Explanations |
|---|---|
| Step 1: Test Equipment Preparation | Ensure all tools & materials are available . |
| Step 2: Sample Preparation | From a cut roll, pull off 3 tissue sample, 2 sheets long<br>Fold in half at perf with embossed side up.<br>Place folded sample on top of cardboard with MD direction parallel with length of board.<br>Flip over sample and cardboard<br>Fold over cut edges<br>Tape securely around cardboard so sample does not move during test<br>Repeat steps 2.2 through 2.5 for the remaining 2 samples |
| Step 3: Loading tissue sample on tester | Place 1 cardboard with tissue sample on the lint tester sample deck<br>Line cardboard up with the rubber padding underneath<br>Lock down each end. |
| Step 4: Measuring Felt ***L*** (Before) Value | If clean felt has been pre-measured for ***L*** value , skip to step 5.<br>Determine the fuzziest side of 3 felt samples by holding the felt up and looking across the top and bottom at the same time.<br>On a ColorTouch2, manufactured by Technidyne Corporation, of New Albany, IN, USA, place felt, fuzzy side up, on the plunger.<br>Press ***Lint*** under ***AutoMeasure,*** then ***Enter,*** then ***Measure***<br>Write the date and ***L*** value on small sticker and place on end of felt strip<br>Store premeasured felt strips in a reclosable plastic bag out of the light |
| Step 5: Felt Preparation for test | Pull 3 pre-measured felt strips from plastic bag<br>Enter the 3 ***L*** value results on TSE-QA-FO-053 under ***L (Before)***<br>Lay felt, fuzzy side up, on pre-scored cardboard.<br>Fold ~1/4" of felt around end of cardboard and tuck inside clip of 4lb weight.<br>Slightly pull felt to fold ~1/4" of felt around the opposite end and tuck in clip to secure<br>Attach weight with felt onto the Sutherland 2000 at the hinge<br>Gently press the right side of the weight so the felt is lying flat and even on the test sample. |
| Step 6: Sutherland 2000 Set up | If the Sutherland 2000 is in Sleep Mode, click the START/STOP button to turn machine on.<br>Set the Count to 5 and Speed to SPEED 2<br>Press the START/STOP button to start test<br>When the machine stops, gently remove the 4 lb. weight with felt by lifting straight up<br>Do not brush across the tissue sample<br>Carefully remove the felt/cardboard from weight<br>Identify sample as 1, 2 or 3 to correspond with its ***L*** **(Before)** value<br>Lay felt aside and cover with a clean white sheet of paper<br>Dispose of tissue sample in trash can - not Broke - due to possible tape contamination<br>Repeat steps 3 through 6 for the remaining two samples |
| Step 7: Reading Test Results | Place the 3 separated felt samples inside a re-closable plastic bag.<br>Take samples to the ColorTouch 2<br>On the ColorTouch 2, place felt, lint side up, on the plunger<br>Press ***Lint*** under ***AutoMeasure***, then ***Enter,*** then ***Measure***<br>Write the ***L*** value under results on TSE-QA-FO-053 under ***L (After)***<br>Subtract the ***L (Before)*** from ***L (After)*** and enter results on form<br>When reading is completed, dispose of felt samples in the trash can. **Do not re-use**.<br>Repeat step 7 for the remaining 2 samples |

Figure 9

CANNABIS FIBER, ABSORBENT CELLULOSIC STRUCTURES CONTAINING CANNABIS FIBER AND METHODS OF MAKING THE SAME

RELATED APPLICATION

This application is a continuation of U.S. patent application Ser. No. 14/939,675, filed Nov. 12, 2015 and entitled *CANNABIS* FIBER, ABSORBENT CELLULOSIC STRUCTURES CONTAINING *CANNABIS* FIBER AND METHODS OF MAKING THE SAME, which in turn is a non-provisional based on U.S. Provisional Patent Application No. 62/078,737, filed Nov. 12, 2014. The contents of these applications are incorporated herein by reference in their entirety.

FIELD OF THE INVENTION

The present disclosure relates to absorbent cellulosic structures manufactured using *cannabis* fibers containing pectin.

BACKGROUND

*Cannabis* is a genus of flowering plants that includes three different species, *Cannabis sativa, Cannabis indica*, and *Cannabis ruderalis*. *Cannabis* has long been used for fiber (hemp), for seed and seed oils, and recently for medicinal purposes. In the mid-1930's, the growth of *cannabis* plants was outlawed in most countries due to its usage as a recreational psychoactive drug. In the 1970's, the ability to test and breed plants to contain low levels of the psychoactive drug, tetra-hydro-cannabinol (THC), became possible. Since this time, many countries have legalized the cultivation of *cannabis* plants that contain low THC content (0.3% or below). Unfortunately; during the period of prohibition; cultivation knowledge, processing equipment, and expertise had been optimized for other natural fibers, such as cotton, and synthetic polymer fibers, resulting in hemp not being economically viable.

Today, the growth and use of *cannabis* is extremely small and relegated to production of the seed for sale to the food industry. Recently, the growth of *cannabis* for use in the pharmaceutical industry has begun. Although not economically feasible to grow solely as a fiber source, the *cannabis* stalk (which is the fiber source) is a waste product when grown for the seed or for the compounds used by the pharmaceutical industry. Therefore, *cannabis* can be economically competitive as a fiber source when the stalks are harvested as a waste product from these industries.

The *cannabis* stalk (or stem) consists of an open cavity surrounded by an inner layer of core fiber, often referred to as hurd, and an outer layer referred to as the bast. Bast fibers are roughly 20% of the stalk mass and the hurd 80% of the mass. The primary bast fiber is attached to the hurd fiber by pectin, a glue like substance. *Cannabis* bast fibers have a large range in length and diameter, but on average are very long with medium coarseness; suitable for making textiles, paper, and nonwovens. The hurd consists of very short, bulky fibers, typically 0.2-0.65 mm in length.

*Cannabis* fibers are hydrophobic by nature. In order for them to be used for paper products, the fibers need to be liberated, typically by oxidation, in order to make them hydrophilic and suitable for use in fabricating paper using a wet laid process. In conventional *cannabis* fiber preparation, the *cannabis* fibers are pulped and bleached to remove the bound lignin and pectin and further separate the fiber bundles that still exist after decortication, the mechanical separation of the fibers in the *cannabis* stalk.

Conventionally, the pulping of *cannabis* is usually an alkaline process where the fibers are added to a digester under elevated temperature and pressure with caustic chemicals (e.g., sodium hydroxide and sodium sulfate) until all fibers are separated from each other. Washing with excess water removes the chemicals and the extracted binding components. The conventional pulping process removes the pectin from the *cannabis* fibers and requires a substantial amount of water when the fibers are added to the digester.

SUMMARY OF THE INVENTION

An object of the present invention is to provide a method of manufacturing absorbent cellulosic structures using *cannabis* fibers in which the *cannabis* fibers are oxidized while leaving a substantial amount of the pectin intact and using less water than the conventional pulping process. In an exemplary embodiment, at least 50% by weight of the amount of original pectin is left intact and the fibers are liberalized using at least 15 liters of water/kg of fiber less than conventional pulping methods.

Another object of the present invention is to provide a use for *cannabis* hurd fibers when only bast fibers are used for the manufacture of paper products.

According to an exemplary embodiment of the invention, Northern Bleached Softwood Kraft pulp is replaced wholly or in part with *cannabis* bast fiber and *eucalyptus* fiber to lower the manufacturing cost of absorbent cellulosic structures. In accordance with the invention, the *cannabis* bast fibers are prepared, pulped, and bleached to allow for the fiber to be incorporated into absorbent cellulosic structures on a wet-laid asset while retaining all or a substantial amount of the pectin with the bast fiber. The wet laid asset can be a tissue machine for making towel, bath tissue or facial tissue. The tissue machine may use through air drying (TAD), or other drying technologies such as dry creping, Structured Tissue Technology (STT), Advantage NTT, equivalent TAD paper (ETAD), uncreped through air drying (UCTAD) or Advanced Tissue Molding System (ATMOS), to name a few, to produce the absorbent cellulosic structure.

The absorbent cellulosic structures of the invention have a low basis weight and high pectin concentration and have equal absorbency, strength, and softness compared to absorbent cellulosic structures of higher basis weight.

Hurd fibers can be prepared together with bast fibers into absorbent cellulosic structures in a similar fashion. Alternatively, when the hurd fibers are not included in the wet laid asset, they can be diverted from the decortification facility and combined with paper mill sludge or dust to form a novel fuel pellet composed of the *cannabis* hurd fibers and wood fiber, derived from the paper mill sludge or dust.

BRIEF DESCRIPTION OF THE DRAWINGS

The features and advantages of exemplary embodiments of the present invention will be more fully understood with reference to the following, detailed description when taken in conjunction with the accompanying figures, wherein:

FIG. 8 illustrates *cannabis* bast and hurd fiber properties as compared to typical softwood and hardwood fibers.

FIG. 9 illustrates the steps required for the lint testing procedure.

DETAILED DESCRIPTION

Figure 1:
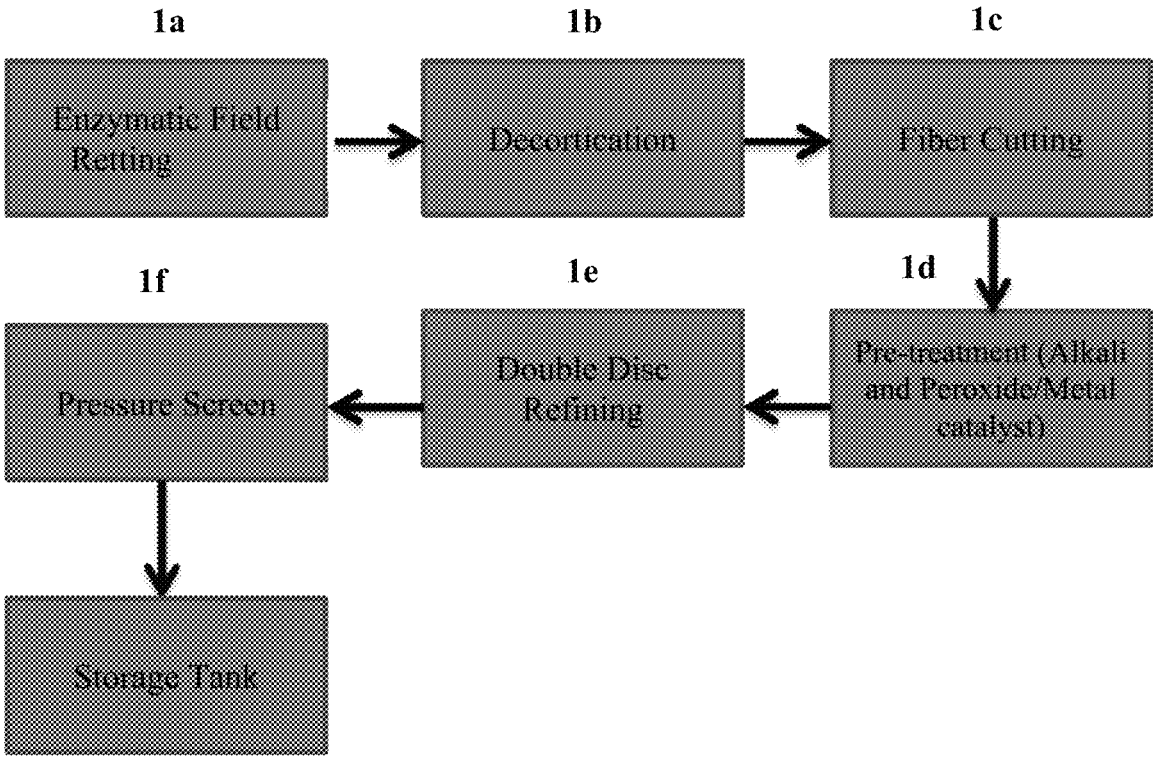
FIG. 1 illustrates *cannabis* fiber processing via enzymatic field retting and refining with alkali, peroxide and catalyst pre-treatment according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

The present invention is directed to the use of *cannabis* fibers in the base sheet of absorbent products, such as tissue or towel products. Such tissue and towel products may be formed using the systems and methods described in U.S. application Ser. No. 13/837,685 (issued as U.S. Pat. No. 8,968,517); Ser. No. 14/534,631; and Ser. No. 14/561,802, the contents of which are incorporated herein by reference in their entirety.

The first step to obtain suitable fibers from the *cannabis* stalk for use in absorbent cellulosic structures such as paper towel, bath, facial tissue, or nonwoven products is enzymatic field retting, as shown in FIGS. 1-4. This involves letting cut *cannabis* plants sit in the field with applied enzymes to degrade components that hold the hurd and bast fibers together in the *cannabis* stalk. This process improves the ability to separate the fibers in the decortication process. The components upon which the enzymes act to cleave molecular bonds are lignin, pectins and extractives. The enzyme solution is engineered to be void of pectinase or other enzymatic components that preferentially attack pectins, thereby increasing fiber yield through this isolation process. Enzymes such as laccase, xylanases, and lignase are preferred so as to minimize any unwanted degradation of the fiber cellulose and hemicellulose while keeping the pectin intact. This enzymatic retting process is carried out under controlled conditions based on the type of enzyme, including control of time, temperature and enzyme concentration to maximize fiber yield and fiber physical properties such as strength.

Next is a decortication stage, shown in FIGS. 1-7, wherein the bast fiber is removed from the woody hurd core using a series of steps. Some of these steps involve chopping the fiber/woody core to smaller lengths, passing the material through one or more hammer mills to separate bast fiber from the woody core followed by several screens to maximize fiber separation from the woody core.

Next is a fiber cutting stage, shown in FIGS. 1-6. During this stage, the bast and hurd fibers are each separately cut to a length preferably 12 mm or less. The length is critical to ensure that the fiber does not fold upon itself or fold around other fiber to create a fiber bundles that can plug processing equipment on the wet laid asset. In this process the fibers are cut to the 0.5 to 20 mm range, preferably to the 3 to 8 mm range, and more preferably to 6 mm. FIG. 8 illustrates typical properties for the *cannabis* hurd and bast fibers as compared to typical softwood and hardwood fibers.

After the fiber bundles are cut to length, the bast fibers are added alone or in combination with the hurd fibers to a hydro-pulper with hot water (50-212° F., preferably 120-190° F.) at a consistency between 0.5 to 30%, preferably between 3 to 6%, and beaten for 20-40 minutes.

Figure 4:
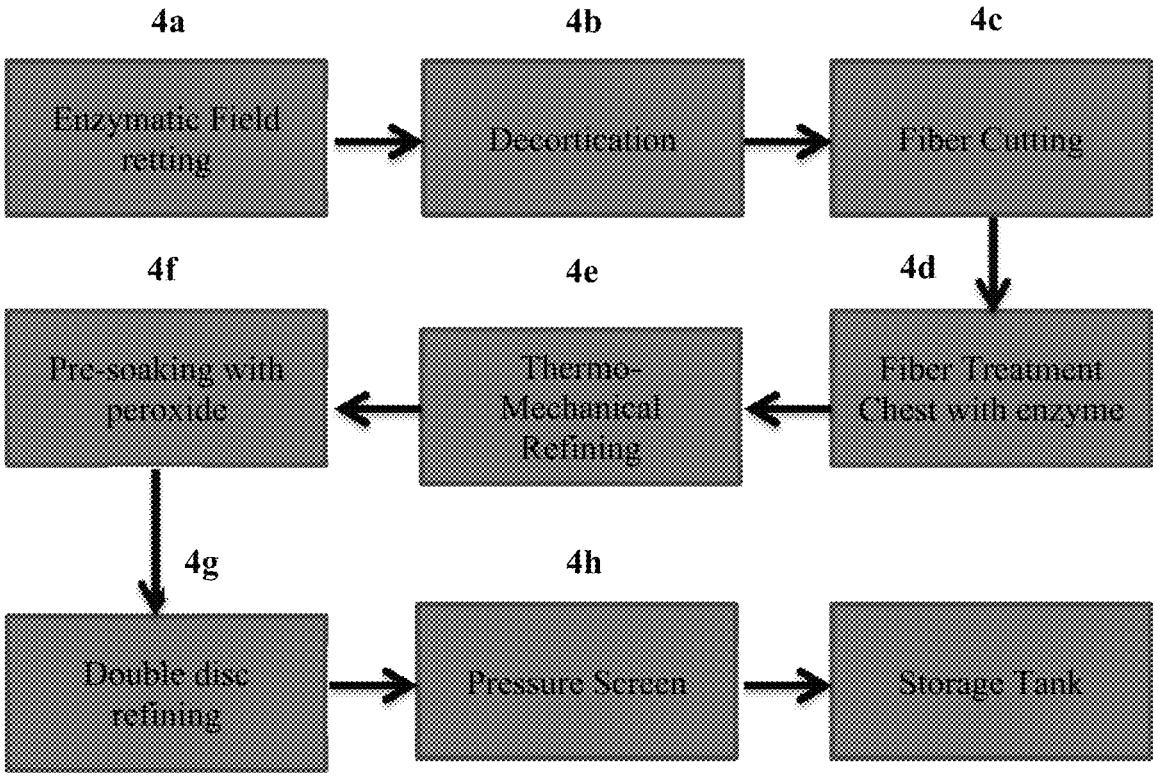
FIG. 4 illustrates *cannabis* fiber processing via enzymatic field retting and two stage refining in the presence of peroxide and steam, including enzymatic pre-treatment according to an exemplary embodiment of the present invention.
Figure 5:
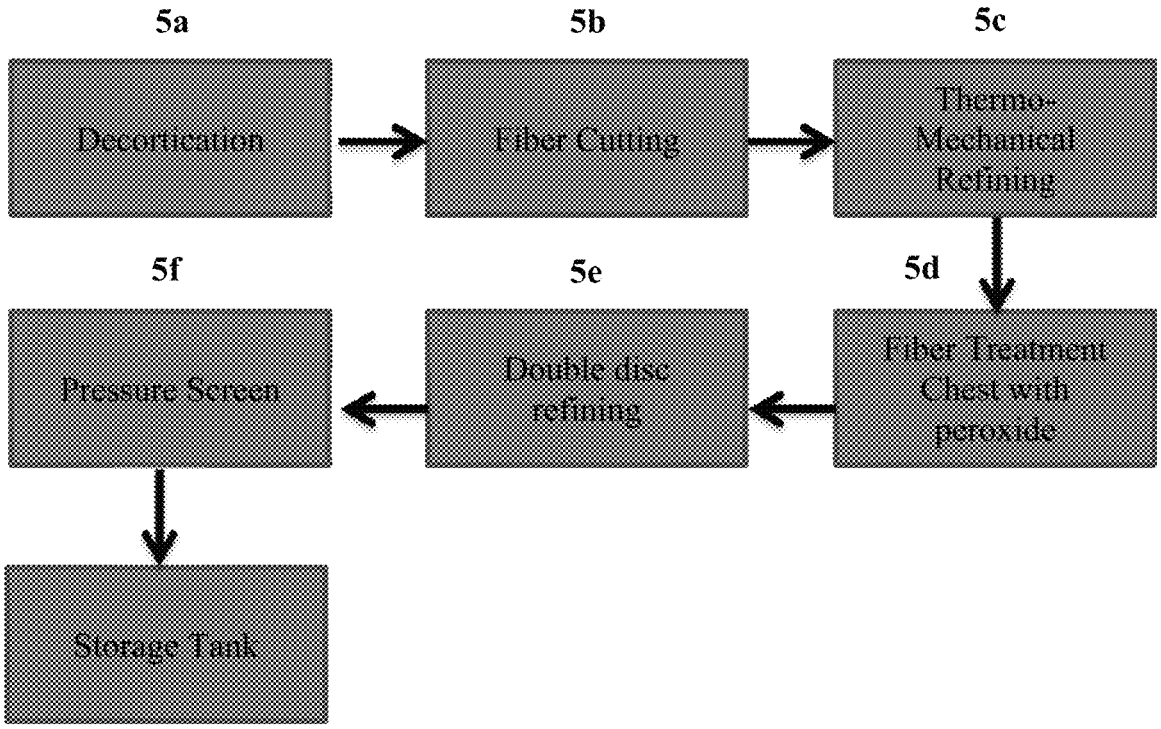
FIG. 5 illustrates *cannabis* fiber processing via two stage refining in the presence of peroxide and steam according to an exemplary embodiment of the present invention.
Figure 6:
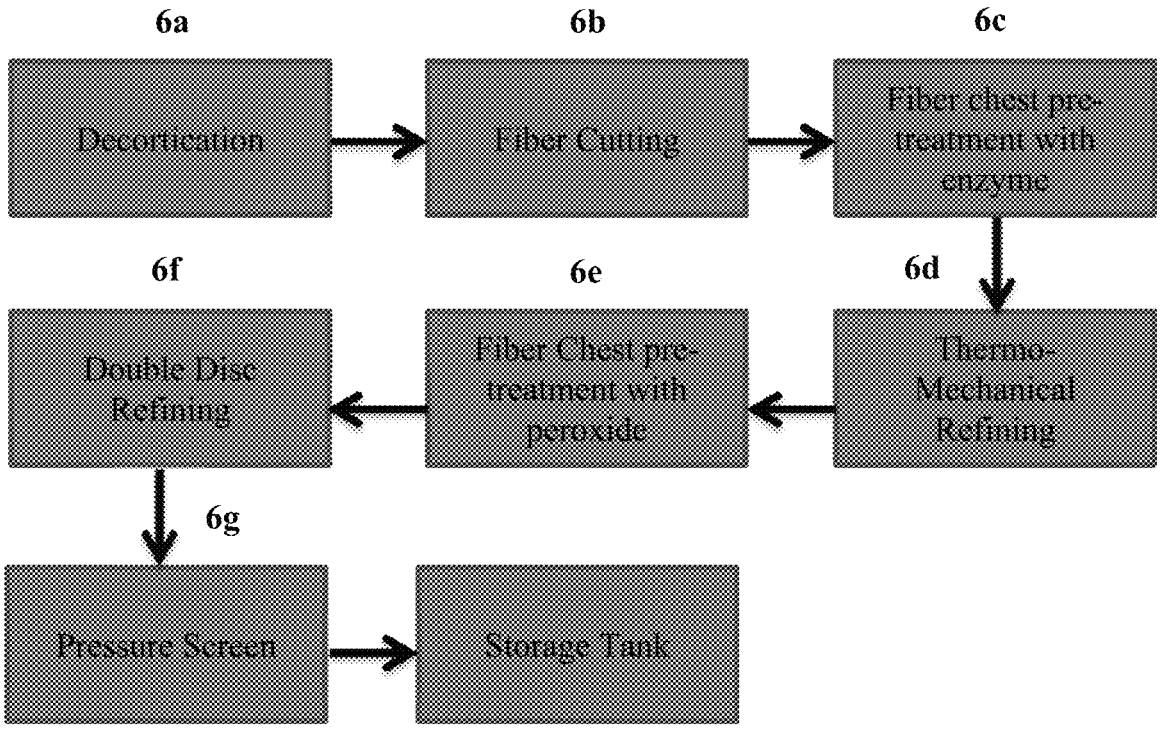
FIG. 6 illustrates *cannabis* fiber processing via two stage refining in the presence of peroxide and steam, including enzymatic pre-treatment according to an exemplary embodiment of the present invention.

After beating, the fibers are pumped to a storage chest, as shown in FIGS. 4-6, and then to a mechanical refiner at a controlled consistency between 2-3%. The fibers may be pumped separately, together, or co-mixed with other wood, plant or synthetic based fibers. The storage chest includes steam injection and agitation to maintain the temperature set-point between 50-212° F. The mechanical refiner can be a disk or conical refiner with plates preferably designed for medium intensity refining.

In the case of a two stage refining process, the fibers will go through a thermo-mechanical refining (TMP) and double disc refiner, as shown in FIGS. 4-6. The mechanical refiner can be a disk or conical refiner with plates preferably designed for medium intensity refining. TMP process involves refining under high temperature and pressure with steam pressure in the range of 2 to 12 bars, preferably between 8 to 10 bars. The additional step of TMP process further aids the lignin removal with limited pectin removal from the fiber, providing uniform fibers for paper and non-woven use.

The preferred energy intensity imparted to the fiber from the refiner should be 40 to 120 kwh/ton such that the fiber bundles are mostly separated into individual fibers.

In the final step, shown in FIGS. 1-6, the refined fibers will go through a pressure screen to remove unprocessed fibers with some moderate washing to remove any unoxidized lignin and/or small amounts of pectins that may have separated from the previous processing steps.

During the fiber preparation process, the fibers must be liberated, in this case through oxidation, in order for the fibers to become hydrophilic so that they may be used in absorbent cellulosic structures. Oxidation of the phenolic material into muconic acids and other carboxylic acid structures in the bound lignin, pectin, and hemicellulose will occur inside the refiner to hydrophilize the fiber surface. The bast and hurd fiber are preferably processed separately through the refiner, but can optionally be co-refined together, or with other wood, plant or synthetic fibers using the process just described.

This process may involve either alkali/enzyme, or peroxide pretreatment as shown in FIGS. 1 through 6 and takes place either in an air stream prior to the hydropulping step described above, or after the hydropulping but before the refining step described above.

This process is a water-efficient method of liberalizing the fibers using at least 15 liters of water/kg of fiber less than conventional pulping methods. The material to liquid ratio in this approach is in the range of 1:1 to 1:10 compared to a material to liquid range of 1:25 to 1:50 in conventional pulping.

For alkali treatment, the fibers will be treated with sodium hydroxide or sodium carbonate at 1 to 10% by weight concentrations on the weight of fibers. For enzymatic treatment, laccase, xylanase and lignase may be used separately or in combination to degum the fibrous materials.

In case of peroxide treatment, hydrogen peroxide or peracetate or ozone may be used in presence of transition metal ions some of which may include scandium, titanium, vanadium, chromium, manganese, iron, cobalt, nickel, copper, zinc, yittrium, zirconium, molybdenum, rhodium, palladium, silver, cadmium, platinum, gold, mercury, etc. The transition metal ions may be added to the hydrogen peroxide at a ratio between 1000 parts hydrogen peroxide to 1 part catalyst to 10 parts hydrogen peroxide to 1 part catalyst.

Peroxide treatment is carried out in alkaline conditions in the presence of sodium hydroxide and/or sodium carbonate. Use of hydrogen peroxide under these conditions may promote catalytic cleavage due to the instability of hydrogen peroxide under these conditions. Also some of the lignin compounds may be broken down via catalytic cleavage and further oxidation. Hydrogen peroxide addition rates may range from 0.25% by weight of fiber to 5% by weight of fiber. Hydrogen peroxide usage may be monitored using an Oxidation Reduction Potential (ORP) meter. The ORP meter target may range from +350 to +500 mV at the injection point of $H_2O_2$, preferably between +350 and +450 mV, before refining and between +100 to +200 mV after refining to ensure depletion of peroxide activity.

In the case of sodium hydroxide addition, base may be controlled using an online pH probe, connected to piping after the discharge of the refiner, to a pH set-point between 7 and 12, preferably between 7 and 10, more preferably between 7 and 9.

Alternatively, the peroxide treatment may be carried out under acid conditions. In that case, hydrogen peroxide mixed with a metal catalyst such as copper (1 part catalyst to 100 parts hydrogen peroxide) is added after urea sulfate addition near the inlet to the refiner where the oxidation reduction potential of the fiber slurry prior to the mechanical refiner is controlled to between +300 and +500 mV, preferably between +350 and +450 mV, or where the oxidation reduction potential of the fiber slurry after the mechanical refiner is controlled to between −100 mV and −200 mV.

In the case where acid is used the acid may be controlled using an online pH probe, connected to piping after the discharge of the refiner, to a pH set-point between 4 and 7 in the case and preferably between 4 and 7.

The oxidized fibers are then blended with other fibers as necessary to create absorbent cellulosic structures with unique properties. The oxidized fibers are blended with wood based fibers that have been processed in any other manner such as chemical (sulfite, kraft), thermal, mechanical, or a combination of these techniques. The fibers could also be synthetic. When Northern Bleached Softwood Kraft (NBSK) pulp fibers are replaced with *cannabis* bast fibers, processed with the method described herein, the tensile strength of the absorbent cellulosic structures can be up to 100% greater. Rather than allowing the strength of the product to increase this significantly, only a portion of the NBSK pulp can be replaced and the tensile strength brought back to target by either decreasing the basis weight, decreasing overall refining, or substituting some of the remaining NBSK with weaker short fiber such as *eucalyptus* or *cannabis* hurd fiber.

Figure 7:
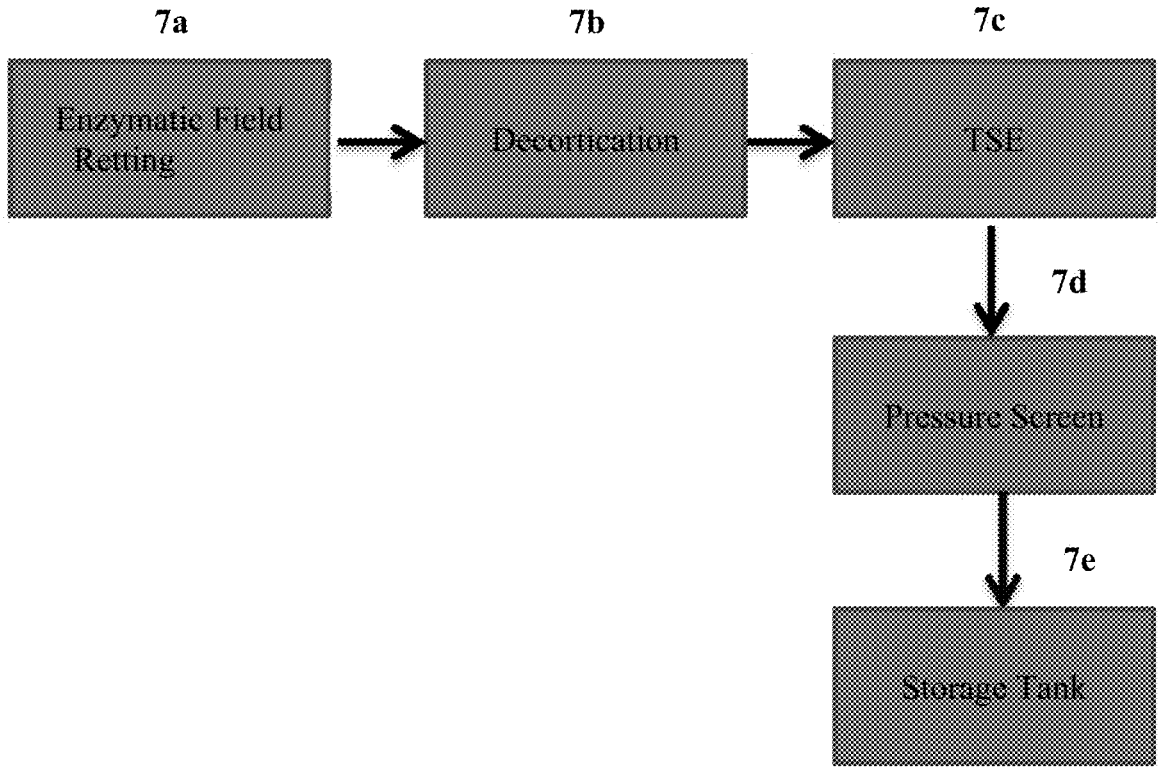
FIG. 7 illustrates *cannabis* fiber processing using a twin screw extruder according to an exemplary embodiment of the present invention.

FIG. 7 shows a fiber processing method according to a preferred exemplary embodiment of the present invention. In this process, decortication and (optionally) enzymatic field retting are performed as described above. However, rather than separate cutting and pre-treatment steps (including oxidation of the fibers through alkali/enzyme, or peroxide pretreatment), these steps may be combined together through the use of a twin screw extruder, as described in U.S. Pat. Nos. 4,088,528 and 4,983,256 and EP 0979895 A1, the contents of which are incorporated herein by reference in their entirety. Alternatively, a twin screw extruder is used only for the cutting step, and the pre-treatment step is performed separately. Although the process shown in FIG. 7 does not show a separate refining step, it should be appreciated that the process may include mechanical and/or thermo-mechanical refining of the fibers as described with reference to FIGS. 1-6.

Figure 10:
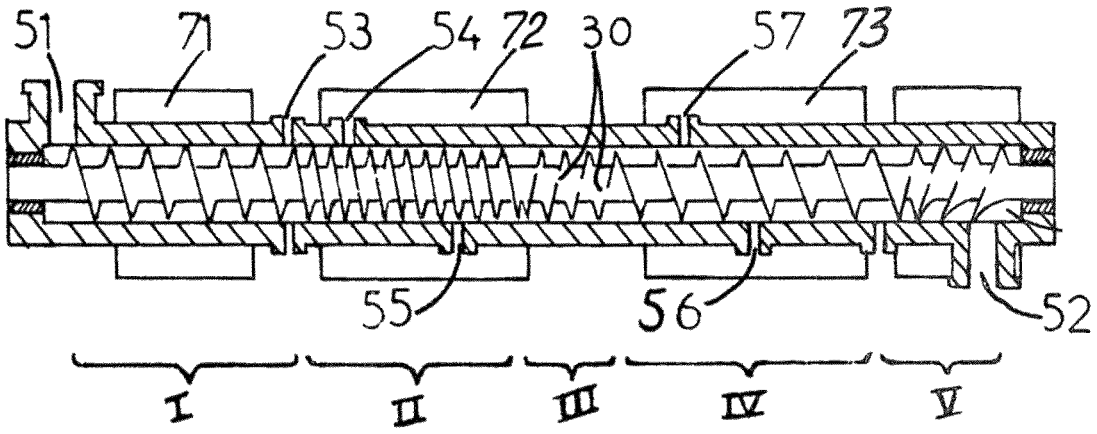
FIG. 10 shows a twin screw extruder usable in various exemplary embodiments of the present invention.

FIG. 10 illustrates a conventional twin screw extruder, generally designated by reference number 50, that may be used in exemplary embodiments of the present invention. The twin screw extruder 50 includes two parallel screws (only one screw 60 is shown in FIG. 10) driven to rotate about their axes within an elongate enclosure. The screws are provided with helical threads which engage one another as the screws rotate. The unprocessed fiber is provided to the twin screw extruder 50 through inlet opening 51 and the rotation of the screws causes advancement of the fibers towards outlet opening 52. The compression and shear forces within the twin screw extruder 50 result in grinding of the fibers. Further, as the fibers advance through the twin screw extruder 50, they may be subjected to heat and/or chemical treatment by heating elements 71, 72, 73 and through introduction of chemical reagents through openings 53, 54, 57. Waste may be collected through openings 55, 56 and either disposed of or recycled. By varying the temperature, chemical mixture and orientation of the threads along the screw lengths, various fiber treatment zones I, II, III, IV and V are created along the length of the twin screw extruder 50.

The fiber slurry produced as described with reference to FIGS. 1-7 is then supplied to a headbox to manufacture absorbent cellulosic structures on a wet laid asset such as any of the type used to produce tissue products such as conventional, ATMOS, NTT, ETAD, TAD, or UCTAD wet laid machines.

Each of the processing steps described above can be used as a stand-alone processing step or the steps can be done in any combination.

Produced tissue products include bath tissue, facial tissue or towel product containing *cannabis* bast or hurd fibers.

The bath or facial tissues can be 1, 2, or 3 ply products, preferably 2-ply products with a basis weight between 20 to 45 g/m$^2$, preferably 30 to 40 g/m$^2$, and more preferably 32 to 38 g/m$^2$.

The bath or facial tissue products have a caliper between 0.200 mm and 0.700 mm, preferably between 0.525 mm and 0.650 mm, and most preferably between 0.575 mm and 0.625 mm.

The bath or facial tissue products have an MD tensile between 190 N/m and 100 N/m, preferably between 170 and 120 N/M and a CD tensile of between 125 N/m and 25 N/m, preferably between 50 and 100 N/m.

The bath or facial tissue products have a ball burst between 100 and 300 grams force, preferably between 175 and 275 grams force.

The bath or facial tissue products have a lint value between 2 and 10, preferably between 3 to 6.

The bath or facial tissue products have an MD stretch between 10 and 30%, preferably between 20 and 30%.

The bath or facial tissue products have a TSA between 80 and 120, preferably between 90 and 110, a TS7 value between 5 and 15, preferably between 7 and 10, and a TS750 between 10 and 20, preferably between 10 and 15.

The towel product has a basis weight from 20 to 70 g/m$^2$, preferably 30 to 40 g/m$^2$, and more preferably 32 to 38 g/m$^2$.

The towel product has a caliper between 0.500 mm and 1.200 mm, preferably between 0.700 mm and 1.000 mm, and most preferably between 0.850 and 1.000 mm.

The towel product has an MD tensile between 300 N/m and 700 N/m, preferably between 300 and 500 N/m and a CD tensile of between 300 N/m and 700 N/m, preferably between 300 and 500 N/m.

The towel product has a ball burst between 500 and 1500 grams force, preferably between 800 and 1500 grams force.

The towel product has an MD stretch between 10 and 30%, preferably between 10 and 20%.

The towel product has an absorbency between 500-1000 gsm, preferably between 600-800 gsm.

The towel product has a TSA between 40 to 80, preferably between 50 and 70.

When the hurd fiber is not combined with the bast fiber and incorporated into an absorbent cellulosic structure, the hurd fiber can be combined with paper waste from a paper mill. Paper mill sludge has a significant water content (over 10%) and it is uneconomical to dry it sufficiently to be utilized as a fuel source. Therefore the sludge is usually disposed of as a waste product. The sludge is usually obtained by clarifying and dewatering the solids from the paper mill waste water stream. The solids obtained are usually over 95% cellulosic based fiber.

Hurd fiber can be combined with sludge removed from waste water to form a precursor material for conversion into fuel pellets. Paper dust may also be collected and combined with the hurd fiber prior to adding the sludge. The precursor material can then be sent through a fuel pelletizer to obtain a pellet with a moisture content below 10%, a requirement for most commercially sold fuel pellets.

Softness Testing

Softness of a 2-ply tissue web was determined using a Tissue Softness Analyzer (TSA), available from EMTECH Electronic GmbH of Leipzig, Germany. A punch was used to cut out three 100 cm$^2$ round samples from the web. One of the samples was loaded into the TSA, clamped into place, and the TPII algorithm was selected from the list of available softness testing algorithms displayed by the TSA. After inputting parameters for the sample, the TSA measurement program was run. The test process was repeated for the remaining samples and the results for all the samples were averaged. A TSA (overall softness), TS7 (bulk structure softness), and TS750 (surface structure softness) reading are obtained.

Ball Burst Testing

Ball Burst of a 2-ply tissue web was determined using a Tissue Softness Analyzer (TSA), available from EMTECH Electronic GmbH of Leipzig, Germany using a ball burst head and holder. A punch was used to cut out five 100 cm$^2$ round samples from the web. One of the samples was loaded into the TSA, with the embossed surface facing down, over the holder and held into place using the ring. The ball burst algorithm was selected from the list of available softness testing algorithms displayed by the TSA. The ball burst head was then pushed by the EMTECH through the sample until the web ruptured and the grams force required for the rupture to occur was calculated. The test process was repeated for the remaining samples and the results for all the samples were averaged.

Stretch & MD, CD, and Wet CD Tensile Strength Testing

An Instron 3343 tensile tester, manufactured by Instron of Norwood, Mass., with a 100N load cell and 25.4 mm rubber coated jaw faces was used for tensile strength measurement. Prior to measurement, the Instron 3343 tensile tester was calibrated. After calibration, 8 strips of 2-ply product, each one inch by four inches, were provided as samples for each test. For testing MD tensile strength, the strips are cut in the MD direction and for testing CD tensile strength, the strips are cut in the CD direction. One of the sample strips was placed in between the upper jaw faces and clamp, and then between the lower jaw faces and clamp with a gap of 2 inches between the clamps. A test was run on the sample strip to obtain tensile and stretch. The test procedure was repeated until all the samples were tested. The values obtained for the eight sample strips were averaged to determine the tensile strength of the tissue. When testing CD wet tensile, the strips are placed in an oven at 105° C. for 5 minutes and saturated with 75 microliters of deionized water immediately prior to pulling the sample.

Lint Testing

FIG. 9 describes a lint testing procedure using a Sutherland® 2000™ Rub tester, manufactured by Danilee Co., of San Antonia, Tex., USA.

Basis Weight

Using a dye and press, six 76.2 mm by 76.2 mm square samples were cut from a 2-ply product being careful to avoid any web perforations. The samples were placed in an oven at 105° C. for 5 minutes before being weighed on an analytical balance to the fourth decimal point. The weight of the sample in grams is divided by 0.0762 m$^2$ to determine the basis weight in grams/m$^2$.

Caliper Testing

A Thwing-Albert ProGage 100 Thickness Tester, manufactured by Thwing Albert of West Berlin, N.J., USA was used for the caliper test. Eight 100 mm×100 mm square samples were cut from a 2-ply product. The samples were then tested individually and the results were averaged to obtain a caliper result for the base sheet.

Absorbency Testing

An M/K GATS (Gravimetric Absorption Testing System), manufactured by M/K Systems, Inc., of Peabody, Mass., USA was to test the absorbency of the two-ply product.

In accordance with one exemplary embodiment, tissue made on a wet-laid asset with a three layer headbox is produced using the through air dried method. A Prolux 005 TAD fabric design supplied by Albany International Corp. of Rochester, N.H., USA, is utilized. The fabric is a 5 shed design with a warp pick sequence of 1,3,5,2,4, a 17.8 by 11.1 yarn/cm Mesh and Count, a 0.35 mm warp monofilament, a 0.50 mm weft monofilament, a 1.02 mm caliper, with a 640 cfm and a knuckle surface that is sanded to impart 27% contact area with the Yankee dryer. The flow to each layer of the headbox is about 33% of the total sheet. The three layers of the finished tissue from top to bottom are labeled as air, core and dry. The air layer is the outer layer that is placed on the TAD fabric, the dry layer is the outer layer that is closest to the surface of the Yankee dryer and the core is the center section of the tissue. The tissue is produced with 45% *eucalyptus,* 55% NBSK fiber in the air layer; 50%

*eucalyptus,* 25% NB SK, and 25% bast *cannabis* fiber in the core layer; and 100% *eucalyptus* fiber in the dry layer.

The *cannabis* bast fiber is prepared as shown in FIG. 1 by cutting decorticated bast fibers to 6 mm length, beating the fiber at 4% consistency in a pulper using 190° F. water for 30 minutes. The slurry is then pumped to a holding tank with steam injection to hold the slurry temperature to 190° F. before being pumped to a conical refiner model RGP 76 CD supplied by Valmet Corporation of Espoo, Finland.

The bast fibers are oxidized using one of two methods. Using the standard alkaline control process, the pH of the slurry is controlled with sodium hydroxide injection to the suction of the pump supplying the refiner to a pH of 8. Alternatively, the pH of the slurry is controlled with sodium hydroxide injection to the suction of the pump supplying the refiner to a pH within a range of 7-12, preferably within a range of 7-10, and more preferably the pH is 8. Hydrogen peroxide is added after sodium hydroxide addition near the inlet to the refiner and controlled by using ORP (oxidation reduction potential) meter to control to an ORP set-point between +350 and +500 mV at the injection point of $H_2O_2$ (before refining) and target+100 to +200 mV after refining to ensure depletion of peroxide activity.

In the case where sodium hydroxide is added, hydrogen peroxide mixed with a metal catalyst such as copper (1 part catalyst to 100 parts hydrogen peroxide) is added after sodium hydroxide addition near the inlet to the refiner and controlled by an ORP (oxidation reduction potential) probe at the discharge of the refiner to a target range of +100 to +200 mV.

Using the acid control process, the pH of the slurry is controlled with urea sulfate injection to the suction of the pump supplying the refiner to a pH within a range of 6-7, preferably within a range of 5-7 and more preferably the pH is 5.

In the case where urea sulfate is added, hydrogen peroxide mixed with a metal catalyst such as copper (1 part catalyst to 100 parts hydrogen peroxide) is added after urea sulfate addition near the inlet to the refiner where the oxidation reduction potential of the fiber slurry prior to the mechanical refiner is controlled to between +300 and +500 my, preferably between +350 and +450 mV, or where the oxidation reduction potential of the fiber slurry after the mechanical refiner is controlled to between −100 mV and −200 mV.

The refining energy imparted to the fiber slurry is 80 kwh/ton. The bast fiber is then added to the core layer blend chest where it is mixed with the NBSK, processed separately, before being pumped and diluted through a fan pump to feed the middle layer of the 3-layer headbox.

The tissue, according to the first exemplary embodiment, is produced with chemistry described in U.S. patent application Ser. No. 13/837,685, the contents of which are incorporated herein by reference, with addition of a temporary wet strength additive, Hercobond 1194 (supplied by Ashland of Wilmington, Del., USA) to the air layer, a dry strength additive, Redibond 2038 (supplied by Corn Products, of Bridgewater, N.J., USA) split 75% to the air layer, 25% to the dry layer, and a softener/debonder, T526 (supplied by EKA Chemicals Inc., of Marietta, Ga., USA) added in combination to the core layer. The T526 is a softener/debonder combination with a quaternary amine concentration below 20%.

The tissue is then plied together to create a rolled 2-ply sanitary tissue product with 190 sheets, a roll firmness of 6.5, a roll diameter of 121 mm, with sheets having a length and width of 4.0 inches. The 2-ply tissue product further has the following product attributes: basis weight of 37 g/m$^2$, caliper of 0.610 mm, MD tensile of 150 N/m, CD tensile of 90 N/m, a ball burst of 240 grams force, a lint value of 5.5, an MD stretch of 18%, a CD stretch of 6%, a CD wet tensile of 14 N/m, a TSA of 93, a TS7 of 8.5, and a TS750 of 14.

Figure 2:
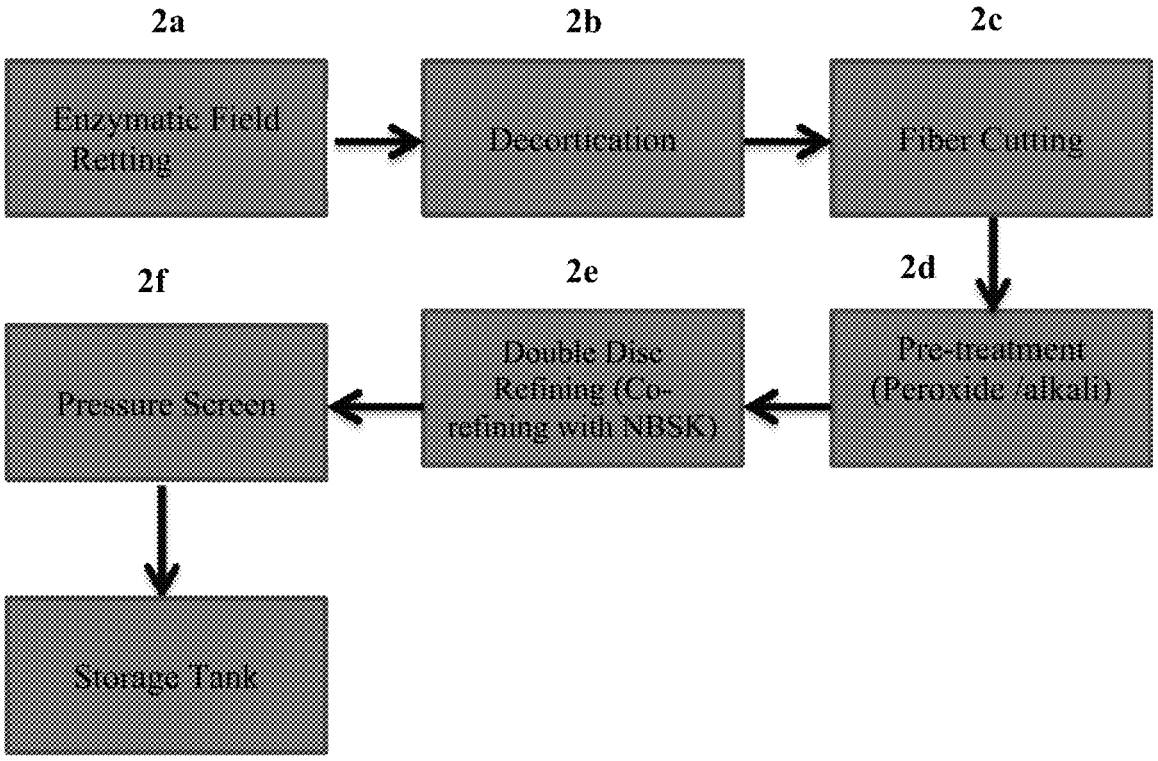
FIG. 2 illustrates *cannabis* fiber processing via enzymatic field retting and co- and refining with NBSK fibers with alkali and peroxide pretreatment according to an exemplary embodiment of the present invention.
Figure 3:
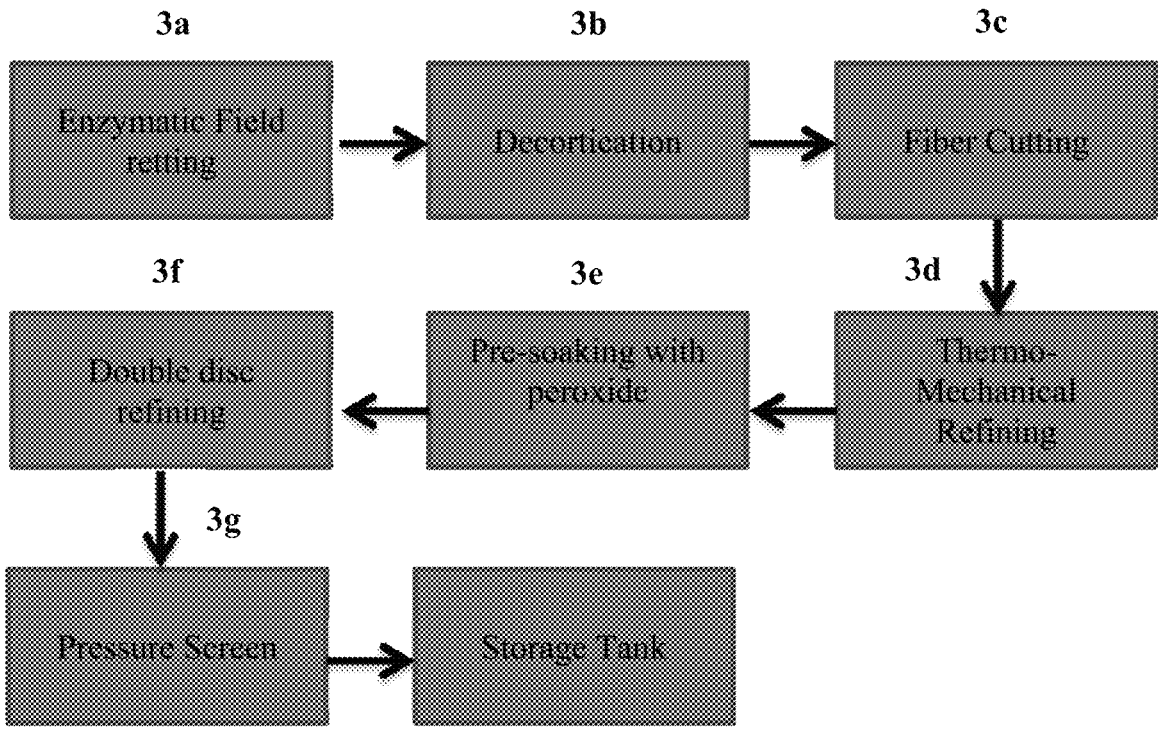
FIG. 3 illustrates *cannabis* fiber processing via enzymatic field retting and two stage refining in the presence of peroxide and steam according to an exemplary embodiment of the present invention.

In a second exemplary embodiment, the product is made in the same manner as the first exemplary embodiment, resulting in the same physical properties of the 2-ply tissue roll. The only exception being that the *cannabis* bast and NBSK fiber are processed through the refiner together with 40 kwh/ton energy intensity as shown in FIG. 2. Since processed together, the slurry mixture is roughly 25% bast fiber, 75% NBSK which is then pumped to the core and air layer blend chest. The final fiber distribution is 100% *eucalyptus* to the Yankee layer, with the air and core layer being 47.5% *eucalyptus,* 12.5% bast, and 40% NB SK.

In another exemplary embodiment, the product is made in the same manner as the first exemplary embodiment except the Yankee layer fiber content is 90% *eucalyptus* and 10% *cannabis* hurd fiber. The hurd fiber is processed separately in the manner described in the first exemplary embodiment but with an energy intensity of 30 kwh/ton provided by a separate refiner.

In another exemplary embodiment, paper towel made on a wet-laid asset with a three layer headbox is produced using the through air dried method. A TAD fabric design described in U.S. Pat. No. 5,832,962 and supplied by Albany International Corp. of Rochester, N.H., USA was utilized. The fabric is a 13 shed design with 12.0 yarn/cm Mesh and Count, a 0.35 mm warp monofilament, a 0.50 mm weft monofilament, a 1.29 mm caliper, with a 670 cfm and a knuckle surface that is sanded to impart 12% contact area with the Yankee dryer. The flow to each layer of the headbox is about 33% of the total sheet. The three layers of the finished tissue from top to bottom are labeled as air, core and dry. The air layer is the outer layer that is placed on the TAD fabric, the dry layer is the outer layer that is closest to the surface of the Yankee dryer and the core is the center section of the tissue. The tissue is produced with 20% *eucalyptus,* 15% *cannabis* bast fiber, and 65% NBSK. The Yankee layer fiber is 50% *eucalyptus,* 50% NBSK. Polyamine polyamide-epichlorohydrin resin at 10 kg/ton (dry basis) and 4 kg/ton (dry basis) of carboxymethyl cellulose are added to each of the three layers to generate permanent wet strength.

The *cannabis* fiber is prepared using the process described in FIG. 4. Following the decortication step, the decorticated bast fibers are cut to 6 mm length, beating the fiber at 4% consistency in a pulper at a temperature of 190° F. for 30 minutes. The slurry is then pumped to a holding tank with steam injection to hold the slurry temperature to 190° F. before being pumped to a conical refiner model RGP 76 CD supplied by Valmet Corporation of Espoo, Finland.

The bast fibers are oxidized using one of two methods. Using the standard alkaline control process, the pH of the slurry is controlled with caustic injection to the suction of the pump supplying the refiner. Hydrogen peroxide is added after caustic addition near the inlet to the refiner and controlled by using ORP (oxidation reduction potential) meter to control to an ORP set-point between +350 and +500 mV at the injection point of $H_2O_2$ (before refiner) and target+100 to +200 mV after refining to ensure depletion of peroxide activity.

Using the acid control process, the pH of the slurry is controlled with sulfuric acid injection to the suction of the pump supplying the refiner. Hydrogen peroxide and a metal catalyst such as iron (1 part catalyst to 100 parts hydrogen peroxide) is added after acid addition near the inlet to the refiner where the oxidation reduction potential of the fiber slurry prior to the mechanical refiner is controlled to between +300 and +500 mV, preferably between +350 and +450 mV, or where the oxidation reduction potential of the fiber slurry after the mechanical refiner is controlled to between −100 mV and −200 mV.

The refining energy imparted to the fiber slurry is 80 kwh/ton. The bast fiber is then added to the core and air layer blend chests where it is mixed with the NBSK and *eucalyptus*, processed separately, before being pumped and diluted through fan pumps to feed two layers of the 3-layer headbox.

The towel is then plied together to create a rolled 2-ply product with 142 sheets, a roll diameter of 142 mm, with sheets having a length of 6.0 inches and a width of 11 inches. The 2-ply tissue product further has the following product attributes: basis weight of 39 g/m$^2$, caliper of 0.850 mm, MD tensile of 385 N/m, CD tensile of 365 N/m, a ball burst of 820 grams force, an MD stretch of 18%, a CD stretch of 6%, a CD wet tensile of 105 N/m, an absorbency of 750 gsm, and a TSA of 53.

The invention claimed is:

1. A method of forming a base sheet of a bath tissue, facial tissue or towel product, comprising processing of *cannabis* fibers made up of bast fibers and hurd fibers as follows:

decorticating the *cannabis* fibers to at least partially remove the hurd fibers from the bast fibers;

cutting the bast fibers to a length of 6 mm to 10 mm;

bleaching the bast fibers at a twin screw extruder;

refining the bleached bast fibers; and delivering the refined and bleached bast fibers to a blend chest of a papermaking machine, wherein the processed *cannabis* fiber contains at least 50% by weight of original amount of pectin contained in the *cannabis* fiber prior to processing.

2. The method of claim 1, wherein the step of refining the bleached bast fibers comprises co-refining the bleached bast fibers with northern bleached softwood kraft pulp fiber.

3. The method of claim 1, wherein the step of decorticating comprises passing the bast fibers with the at least partially removed hurd fibers over screens.

4. The method of claim 1, wherein the base sheet comprises at least three layers, at least one of the layers comprising the processed *cannabis* fibers.

* * * * *